United States Patent [19]

Kohama et al.

[11] 4,181,110

[45] Jan. 1, 1980

[54] EXHAUST GAS RECIRCULATION SYSTEM FOR INTERNAL COMBUSTION ENGINE

[75] Inventors: Tokio Kohama, Nishio; Hideki Obayashi, Hoi; Tadashi Ozaki, Nishio; Hidetaka Nohira, Mishima, all of Japan

[73] Assignees: Nippon Soken, Inc., Nishio; Toyota Jidosha Kogyo Kabushiki Kaisha, Toyota, both of Japan

[21] Appl. No.: 908,460

[22] Filed: May 22, 1978

[30] Foreign Application Priority Data

May 26, 1977 [JP] Japan ..... 52-61393

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 4,031,871 | 6/1977 | Hamanishi | 123/119 A |
| 4,041,917 | 8/1977 | Suzuki | 123/119 A |
| 4,056,084 | 11/1977 | Baumgartner | 123/119 A |
| 4,092,960 | 6/1978 | Nohira et al. | 123/119 A |
| 4,094,287 | 6/1978 | Nohira | 123/119 A |
| 4,112,894 | 9/1978 | Nohira | 123/119 A |
| 4,128,089 | 12/1978 | Takimoto et al. | 123/119 A |
| 4,137,874 | 2/1979 | Otsubo et al. | 123/119 A |

*Primary Examiner*—Wendell E. Burns

*Attorney, Agent, or Firm*—Cushman, Darby & Cushman

[57] ABSTRACT

An exhaust gas recirculation system for an internal combustion engine comprising an exhaust gas recirculation passage for recirculating exhaust gases from an exhaust pipe into an intake pipe downstream of a throttle valve, a control valve responsive to a pressure signal for opening or closing said recirculation passage, a pressure chamber defined within the recirculation passage, a negative pressure control valve to which is transmitted a negative throttle pressure generated at a throttle port at a position upstream of the throttle valve when the latter is completely closed and which controls said negative throttle pressure in response to the load on the engine, and a modulator wherein the pressure from the pressure chamber acts on one surface of a diaphragm while the negative output pressure from the negative pressure control valve acts on the other surface of the diaphragm so that the modulator may control the pressure signal in response to the difference between said two pressures acting on the diaphragm, whereby the amount of exhaust gases recirculated may be made proportional to the load on the engine regardless of the variation in rotational speed of the engine.

4 Claims, 10 Drawing Figures

EXHAUST GAS RECIRCULATION SYSTEM FOR INTERNAL COMBUSTION ENGINE

BACKGROUND OF THE INVENTION

The present invention relates to an exhaust gas recirculation system for an internal combustion engine which is very effective in reduction of NOx emission.

The conventional exhaust gas recirculation systems may be divided into two types. In the one type exhaust gases from an exhaust pipe of an internal combustion engine are recirculated through fixed restriction means into an intake pipe between a carburetor and a throttle valve in such a way that the amount of recirculated exhaust gases may be a function of the pressure in the exhaust pipe. In the other type exhaust gases from the exhaust pipe are recirculated through a restriction means into an intake manifold. Both types of the external exhaust gas recirculation systems are very effective in reduction of NOx emission in exhaust gases.

In addition to the external exhaust gas recirculation systems, the residual gases which remain in the cylinder because of the incomplete scavenging serve to reduce NOx emission to such a degree as comparable with the external exhaust gas recirculation system. Therefore in order to attain the effective reduction in NOx emission in exhaust gases, both the external exhaust gas recirculation and the residual gas (to be referred to as "the internal exhaust gas recirculation" in this specification) must be taken into consideration.

To attain the effective reduction in NOx emission, it is ideal to maintain constant the ratio of the total amount of recirculated exhaust gases (both externally and internally recirculated gases) to the amount of intake air. Since the internal exhaust gas recirculation ratio is inversely proportional to the load on engine; that is, the internal exhaust gas recirculation ratio is low with a heavy load while the ratio is high with a light load, the external exhaust gas recirculation ratio must be made proportional to the load on the engine; that is, the external exhaust gas recirculation ratio must be high with a heavy load and low with a light load.

In the exhaust gas recirculation system wherein the exhaust gases are introduced into the intake pipe upstream of the throttle valve, the ratio of the amount of the recirculated exhaust gases to the amount of intake air may be maintained constant. However this system cannot control the external exhaust gas recirculation ratio in proportion to the load on the engine. Furthermore this system has the problems that the foreign matters adhere to the throttle valve, icing occurs in case of a low temperature and adverse thermal effects on a carburetor result.

In case of the exhaust gas recirculation system of the type wherein exhaust gases are directly introduced into an intake manifold through restriction means, the problems encountered in the above recirculation system wherein the exhaust gases are introduced into the intake pipe upstream of the throttle valve may be eliminated. However this system utilizes a negative pressure in the intake pipe or a negative pressure at a venturi throat in order to control the amount of recirculated exhaust gases. Therefore the amount of recirculated exhaust gases is dependent upon the difference between the back pressure and the negative intake pressure and the opening area of the restriction means, and especially because of the adverse effects from the negative intake pressure the ratio of the amount of the recirculated exhaust gases to the amount of intake air becomes high with a light load and low with a heavy load. In other words, the exhaust gas recirculation system is controlled in a manner completely in opposite to the ideal manner described above. As a result, in case of a light load, surging and misfiring result while in case of a heavy load, the NOx reduction efficiency is considerably decreased.

In order to overcome the problems encountered in the recirculation system wherein the exhaust gases are introduced directly into the intake manifold through the restriction means, an improvement has been proposed and demonstrated wherein a control valve which is actuable in response to the negative intake pressure which is adjusted by a modulator is inserted in the exhaust gas recirculation passage whereby the ratio of the amount of the externally recirculated exhaust gases to the amount of intake air may be maintained constant. However, this improved system is still incapable of controlling the exhaust gas recirculation ratio in response to the variation in load as is the case of the system wherein the exhaust gases are introduced into the intake pipe upstream of the throttle valve.

In order to overcome the above problems the same inventors proposed in a copending U.S. patent application, Ser. No. 871,936, a further improvement of the above improved exhaust gas recirculation system wherein the negative intake pressure to be transmitted through restriction means into the modulator is controlled so as to be in proportion to the load on the engine and the modulator is hydraulically communicated with the surrounding atmospheric pressure through restriction means, whereby the exhaust gas recirculation may be controlled in such an ideal manner that the external exhaust gas recirculation ratio may be proportional to the load; that is, the external exhaust gas recirculation ratio may be high with a heavy load and low with a light load. However, the inventors had found out that even this improved system cannot attain the ideal external exhaust gas recirculation control because of the variation in rotational speed of the engine.

SUMMARY OF THE INVENTION

Accordingly, one of the objects of the present invention is to provide an exhaust gas recirculation system for an internal combustion engine wherein the external exhaust gas recirculation ratio may be made always proportional to the load on the engine regardless of the rotational speed thereof.

The above and other objects, features and advantages of the present invention will become more apparent from the following description of preferred embodiments thereof taken in conjunction with the accompanying drawings.

BRIEF DESCRIPTION OF THE DRAWINGS

Same reference numerals are used to designate similar parts throughout the figures.

DESCRIPTION OF THE PREFERRED EMBODIMENTS

Figure 1:
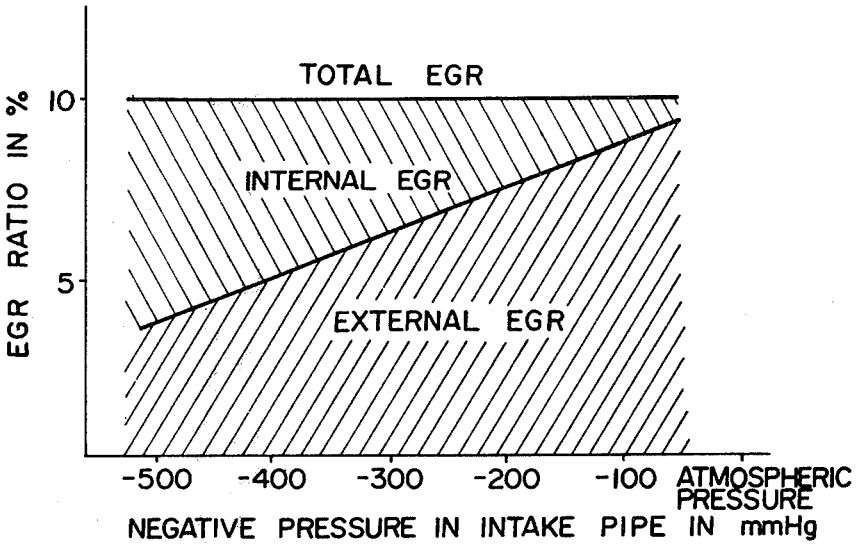
FIG. 1 is a view used for the explanation of the ideal exhaust gas recirculation control.

In order to attain the effective reduction in NOx in exhaust gases emitted from an internal combustion engine over its whole load range, it is ideal to maintain constant the ratio of the total volume of recirculated exhaust gases (externally recirculated exhaust gases+residual gas) to the volume of intake air independently of the load as shown in FIG. 1. However the ratio of the volume of internally recirculated exhaust gases (to be referred as "internal EGR ratio") becomes higher with a light load but becomes lower with a heavy load so that the ratio of the volume of the externally recirculated exhaust gases (to be referred to as "external EGR ratio") must be so controlled as to be low with a light load and high with a heavy load as shown in FIG. 2.

Figure 2:
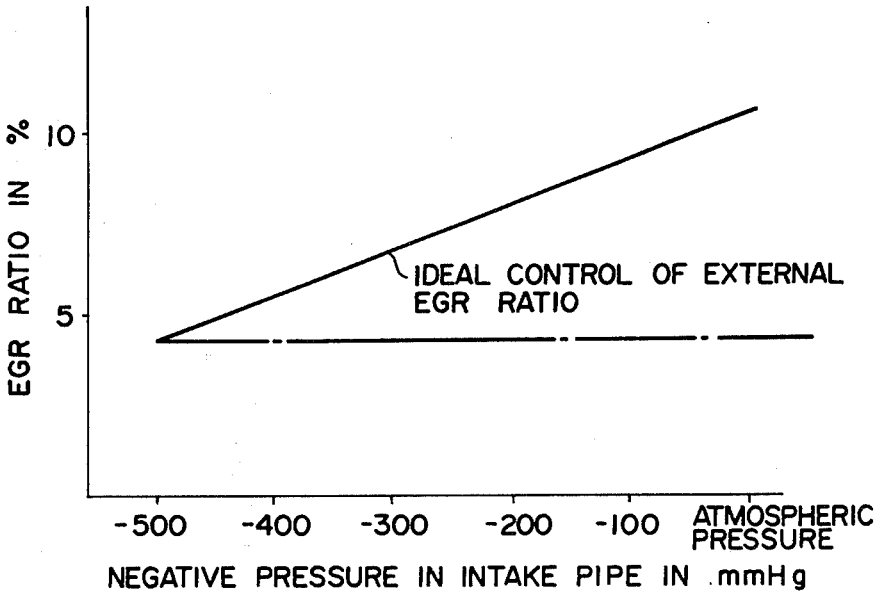
FIG. 2 is a view used for the explanation of the ideal external exhaust gas recirculation.

The present invention has for its object to provide an exhaust gas recirculation system for an internal combustion engine which may attain the ideal control of the external EGR ratio as shown in FIG. 2 as will be described in detail with reference to accompanying drawings.

FIRST EMBODIMENT, FIGS. 3-5

Figure 3:
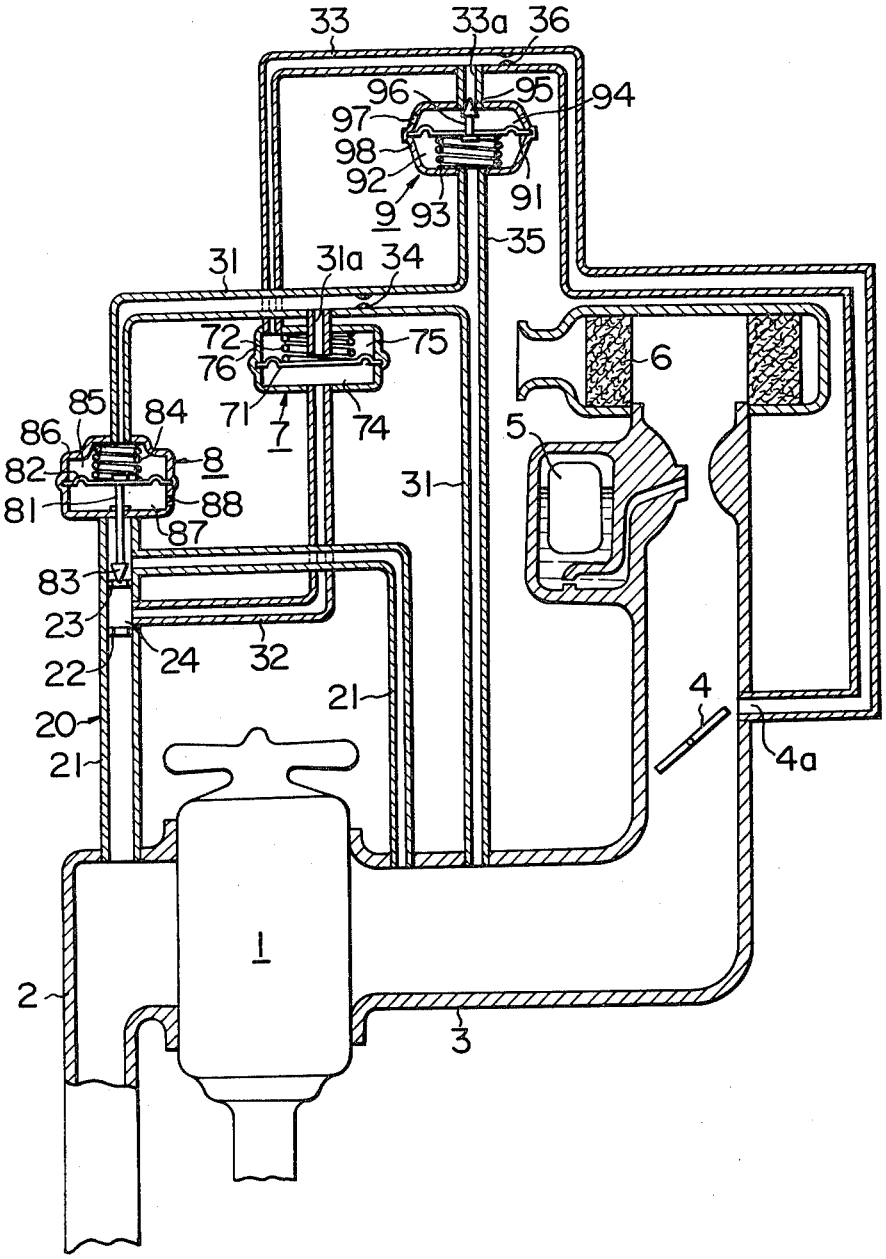
FIG. 3 is a schematic view of a first embodiment of an exhaust gas recirculation system in accordance with the present invention.

Referring to the accompanying drawings and especially FIG. 3, an internal combustion engine 1 is provided with an exhaust pipe 2 and an intake pipe 3 which is communicated with a carburetor 5 and an air cleaner 6. A throttle valve 4 is disposed within the intake pipe 3.

An exhaust gas recirculation system generally indicated by the reference numeral 20 includes a recirculation pipe 21 and a control valve 8. One end of the recirculation pipe 21 is communicated with the exhaust pipe 2 while the other end is communicated with the intake pipe 3 downstream of the throttle valve 4. A restriction 22 and a valve seat 23 are disposed within the recirculation pipe 21 between the control valve 8 and the exhaust pipe 2, and a pressure chamber 24 is defined between the restriction 22 and the valve seat 23. The control valve 8 which is inserted into the recirculation pipe 21 has a valve body 83 which cooperates with the valve seat 23 to define a variable restriction.

The control valve 8 has a housing 86 and a diaphragm 82 which divides the housing 86 into first and second pressure chambers 85 and 86. The first or upper pressure chamber 85 above the diaphragm 82 is applied with a pressure signal through a first pressure pipe 31 with one end communicated with the intake pipe 3. The pressure source of this pressure signal is a negative intake air pressure and the pressure signal is controlled by a modulator 7. The second or lower pressure chamber 87 below the diaphragm 82 is communicated through an air port 88 with the surrounding atmosphere. The valve body 83 is connected to the diaphragm 82 with a valve stem or shaft 81. A bias spring 84 is disposed within the first pressure chamber 85 so that the valve body 83 may be normally pressed against the valve seat 23.

The modulator 7 has a housing 76 and a diaphragm 71 which divides the housing 76 into third and fourth pressure chambers 74 and 75. The lower or third pressure chamber 74 below the diaphragm 71 is communicated through a second pressure pipe 32 with the pressure chamber 24. Within the fourth or upper pressure chamber 75 above the diaphragm 71 is loaded a spring 72 so that the diaphragm 71 may be normally biased downwardly. A correction pressure signal which is controlled by a negative pressure control valve 9 is transmitted into the upper or fourth pressure chamber 75 through a third pressure pipe 33 with one end communicated with a throttle port 4*a*. The source of the correction pressure signal is therefore a negative pressure in the vicinity of the throttle port 4*a*. The upper or fourth pressure chamber 75 is further communicated with the first pressure pipe 31 through a branch pipe 31*a* branched from the first pressure pipe 31 so that the pressure in the fourth or upper pressure chamber 75 may be bled into the first pressure pipe 31 so as to control the level of the pressure signal to be transmitted to the control valve 8. A restriction 34 is inserted in the first pressure pipe 31 upstream of the branched pipe 31*a*.

The negative pressure control valve 9 has a housing 98 and a diaphragm 91 which divides the housing 98 into two pressure chambers 92 and 94. A negative intake pressure is transmitted into the fifth or lower pressure chamber 92 below the diaphragm 91 through the first pressure pipe 31 and a fourth pressure pipe 35 branched from the first pressure pipe 31. A bias spring 93 is loaded in the lower pressure chamber 92 so that the diaphragm 91 may be normally biased upward. When the negative intake pressure becomes approximately 130 mm Hg, the bias spring 93 lifts the diaphragm 91 upward. The negative pressure control valve 9 has a valve body 95 connected to the diaphragm with a shaft 96. The upper or sixth pressure chamber 94 is communicated with the surrounding atmosphere through an air port 97 and with the third pressure pipe 33 through a branch pipe 33*a* branched therefrom. The valve body 95 controls the area of the passage between the branch pipe 33*a* and the upper or the sixth pressure chamber 94, thereby controlling the amount of the atmospheric air to be bled into the third pressure pipe 33 and consequently the correction pressure signal to be transmitted through the third pressure pipe 33 into the fourth or upper pressure chamber 75 of the modulator 7. A restriction 36 is disposed within the third pressure pipe 33 upstream of the branched pipe 33*a*.

Figure 4:
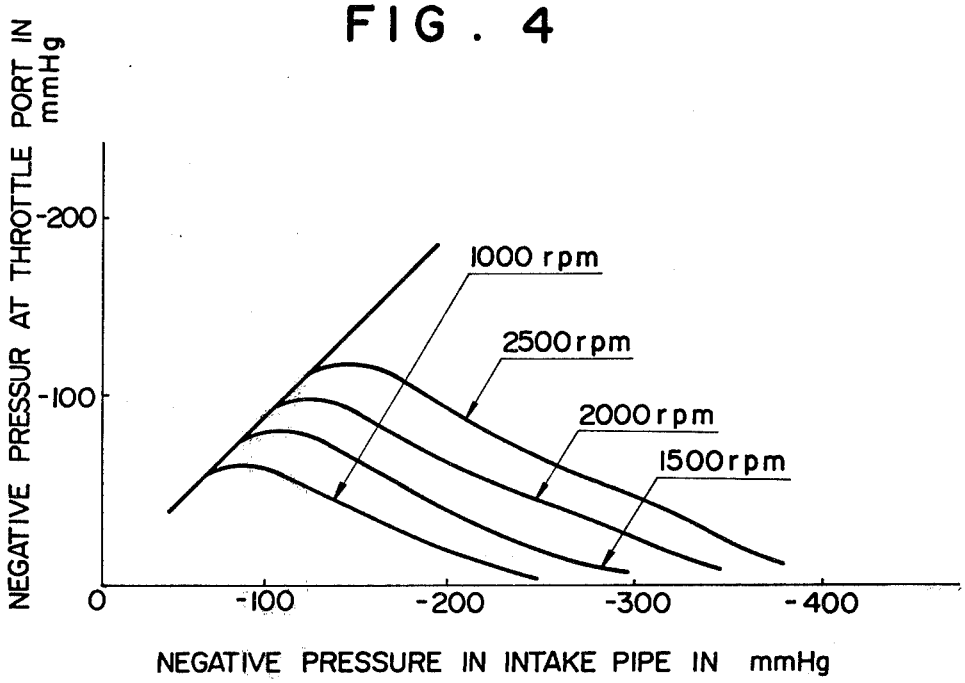
FIG. 4 is a graph illustrating the relationship between the negative throttle pressure and the negative intake pressure.

The term "negative throttle pressure" is used in this specification to refer to a negative pressure produced at the throttle port 4*a* which is located upstream of the throttle valve 4 when the latter is completely closed but is located downstream thereof when the valve 4 is opened beyond a predetermined angle. As shown in FIG. 4, the negative throttle pressure varies depending upon the rotational speed of the engine 1. That is, the negative throttle pressure increases with the rotational speed of the engine 1.

Figure 5:
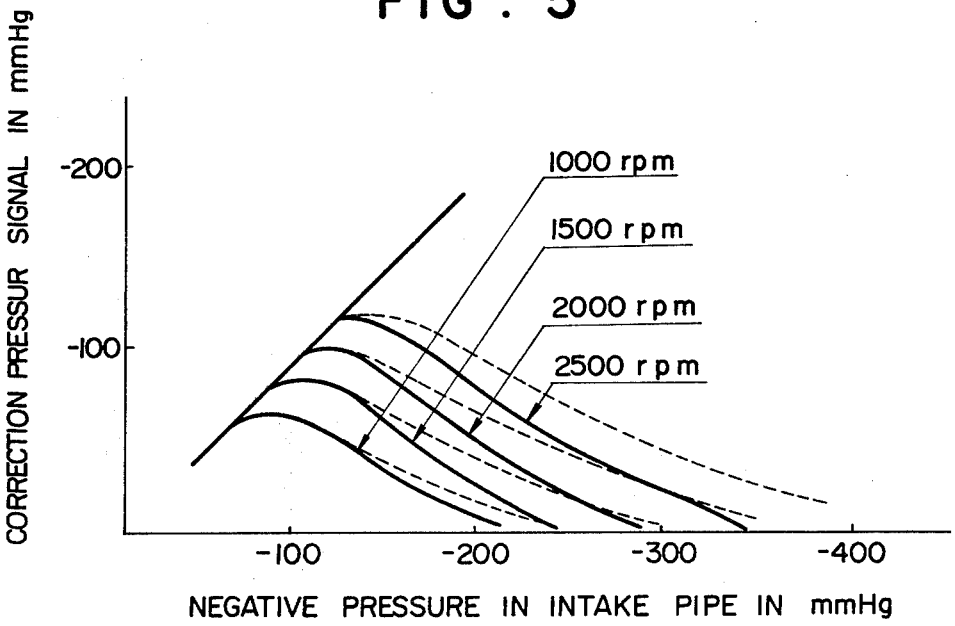
FIG. 5 is a graph illustrating the relationship between the correction pressure signal and the negative intake pressure.

Referring back to FIG. 3, as described above the negative intake pressure is transmitted through the first and fourth pressure pipes 31 and 35 into the lower or fifth pressure chamber 92 of the negative pressure control valve 9 so that the diaphragm 91 deflects itself downward aganst the spring 93 and consequently the valve body 95 is moved away from the opening of the branch pipe 33*a*. As a result, the passage between the branch pipe 33*a* and the upper pressure chamber 94 is increased in area. That is, the area of this passage is controlled depending upon the negative intake pressure transmitted into the lower pressure chamber 92. The amount of the atmospheric air to be introduced into the third pressure pipe 33 through the branch pipe 33*a* is in turn dependent upon the area of this passage. Thus the correction pressure signals as indicated by the solid line curves in FIG. 5 may be obtained and transmitted into the fourth or upper pressure chamber 75 of the modulator 7 as described elsewhere. In FIG. 5 broken line curves represent the negative throttle pressure.

The correction pressure signal which is negative is low when the negative intake pressure is high or when the load is light, but is high when the intake pressure is low or when the load is heavy or when the rotational speed of the engine 1 is high. As a result, the pressure Pe in the pressure chamber 24 negatively increases with the increase in load or rotational speed of the engine 1. The amount of the recirculated gases $Q_{EGR}$ is proportional not only to the square root of the pressure difference ($P_{EX}-Pe$) across the orifice 22 (where $P_{EX}$ is the pressure of the exhaust gases) but also the opening area A of the restriction 22. That is, $$Q_{EGR}=C\cdot A\cdot\sqrt{P_{EX}-Pe}$$

where C=a flow coefficient.

The amount of the recirculated exhaust gases increases with increase in load and rotational speed of the engine 1. Therefore the external EGR ratio increases with increase in load and decreases with decrease in load and is dependent only upon the load but independently of the rotational speed of the engine. Thus the ideal control of the exhaust gas recirculation system may be attained as shown in FIG. 2.

Assume that the pressure Pe in the pressure chamber 24 varies depending only upon the load. Then when the rotational speed of the engine 1 varies under a constant load, the pressure Pe remains constant but the exhaust gas pressure $P_{EX}$ varies so that the external EGR ratio varies under the same load. However, when the pressure Pe varies depending not only upon the load but also upon the rotational speed of the engine, the external EGR ratio may be maintained constant under the same load regardless of the variation in rotational speed of the engine. Therefore the ideal control may be attained as shown in FIG. 2 regardless of the rotational speed of the engine.

Figure 6:
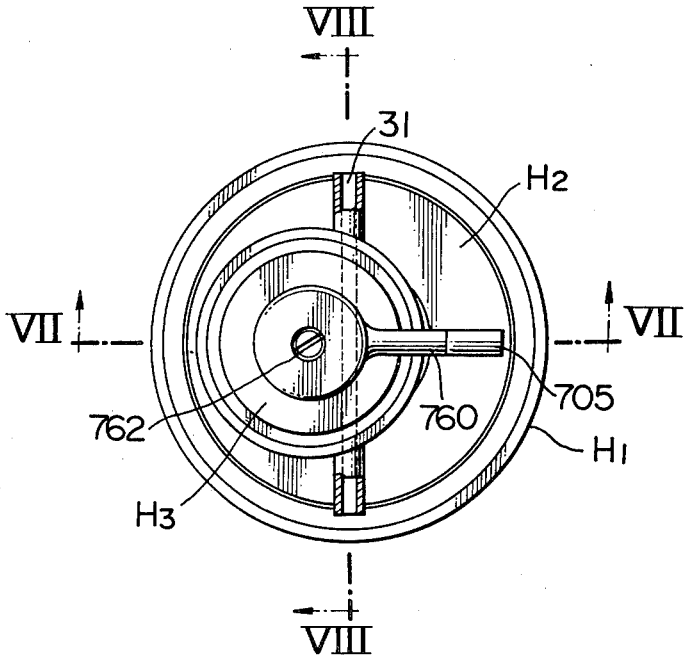
FIG. 6 is a top view of a modification of the first embodiment wherein a modulator and a negative pressure control valve are combined into a unitary construction.
Figure 7:
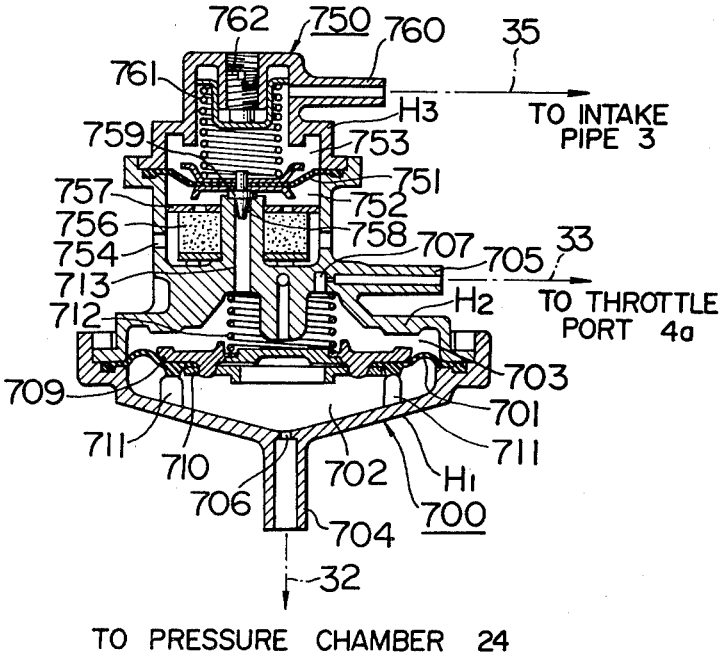
FIG. 7 is a sectional view taken along the line VII—VII of FIG. 6.
Figure 8:
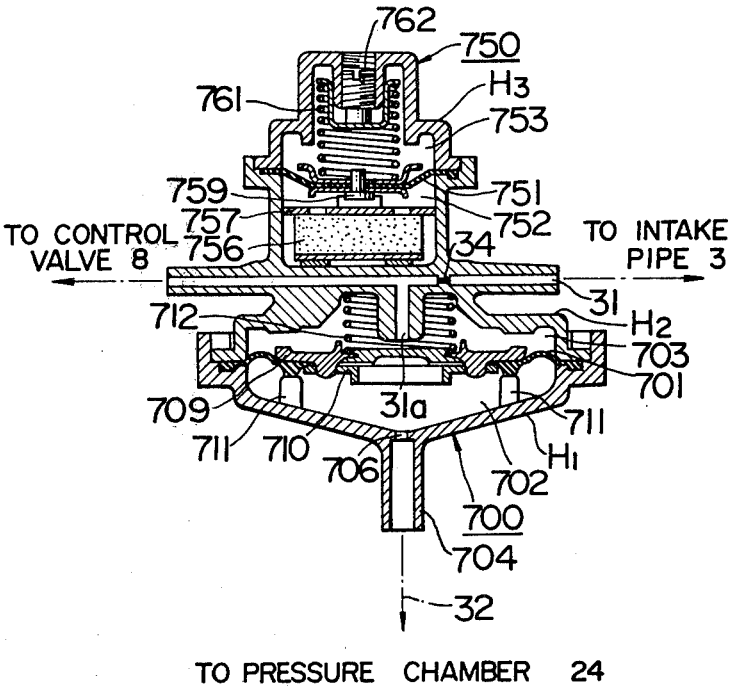
FIG. 8 is a sectional view taken along the line VIII—VIII of FIG. 6.

MODIFICATION, FIGS. 6, 7 and 8

In a modification shown in FIGS. 6, 7 and 8, the modulator 7 and the negative pressure control valve 9 of the first embodiment are combined into a unitary construction. A modulator 700 and a negative pressure control valve 750 have first, second and third housings $H_1$, $H_2$ and $H_3$ made of a suitable plastic. The modulator 700 includes a diaphragm 701 which is sandwiched between the first and second housings $H_1$ and $H_2$ and defines the third or lower pressure chamber 702 below the diaphragm 701 and the fourth or upper pressure chamber 703 above the diaphragm 701. The third or lower pressure chamber 702 is communicated with the pressure chamber 24 (See FIG. 3) through the second pressure pipe 32, a connection 704 and a restriction 706. The upper or fourth pressure chamber 703 is communicated with the throttle port 4*a* through a restriction 707, a connector or inlet 705 and the third pressure pipe 33 and with the fifth pressure chamber 752 through a communication passage 713 extended through the second housing $H_2$.

As best shown in FIG. 8, the first pressure pipe 31 with the restriction 34 is extended through the second housing $H_2$, and the branch pipe 31*a* is branched into the fourth or upper pressure chamber 703 from the first pressure pipe 31 in such a way that the lower opening of the branched pipe 31*a* may be coaxial with the diaphragm 701 and may be made into contact with the diaphragm 701 when the latter is deflected upward as will be described in detail hereinafter. Therefore the pressure in the fourth or upper pressure chamber 703 may be bled or introduced into the first pressure pipe 31 through the branched pipe or passage 31*a* as is the cast of the first embodiment described above with reference to FIG. 3 whereby the pressure signal to be transmitted to the control valve 8 may be controlled.

The diaphragm 701 is clamped by upper and lower clamping plates 709 and 710 and is normally biased downward under the force of a bias spring 712 loaded in the upper pressure chamber 703. The down stroke of the diaphragm 701 is limited by a stopper 711 in the lower pressure chamber 702.

The negative pressure control valve 750 includes a diaphragm 751 the outer peripheral portion of which is clamped between the second and third housings $H_2$ and $H_3$ and which defines the fifth pressure chamber 752 and the sixth pressure chamber 753. The fifth pressure chamber 752 below the diaphragm 751 is communicated with the surrounding atmosphere through an air port 754 formed through the second housing $H_2$ and with the fourth pressure chamber 703 through the communication passage 713 so that the atmospheric pressure may be transmitted into the fourth pressure chamber 703. An air filter 756 is disposed within the fifth pressure chamber 752 and secured thereto with a plate 757 in order to remove the dust or the like entrained in the atmospheric air to be introduced into the fourth air pressure chamber 702. A valve body 758 which is connected to the diaphragm 751 with a shaft 759 moves toward or away from the upper opening of the communication passage 713 as the diaphragm 751 is deflected downward or upward. Therefore the valve body 758 and the upper opening of the communication passage 713 define a variable orifice.

The sixth pressure chamber 753 above the diaphragm 751 is communicated through an inlet 760 and the fourth and first pressure pipes 35 and 31 with the intake pipe 3 (See FIG. 3). A bias spring 761 is loaded in the sixth pressure chamber 753 so that the diaphragm 751 may be normally biased downward. The force of this bias spring 761 may be adjusted by tightening or loosing an adjusting screw 762. In response to the negative pressure transmitted into the sixth pressure chamber 753, the diaphragm 751 is deflected so that the valve body 758 moves toward or away from the upper opening of the communication passage 713 and consequently the amount of the atmospheric air to the introduced into the fourth pressure chamber 703 may be controlled.

The mode of operation of the modulator and negative pressure control valve combination with the above construction is substantially similar to that of the first embodiment described above with reference to FIG. 3.

SECOND EMBODIMENT, FIG. 9

Figure 9:
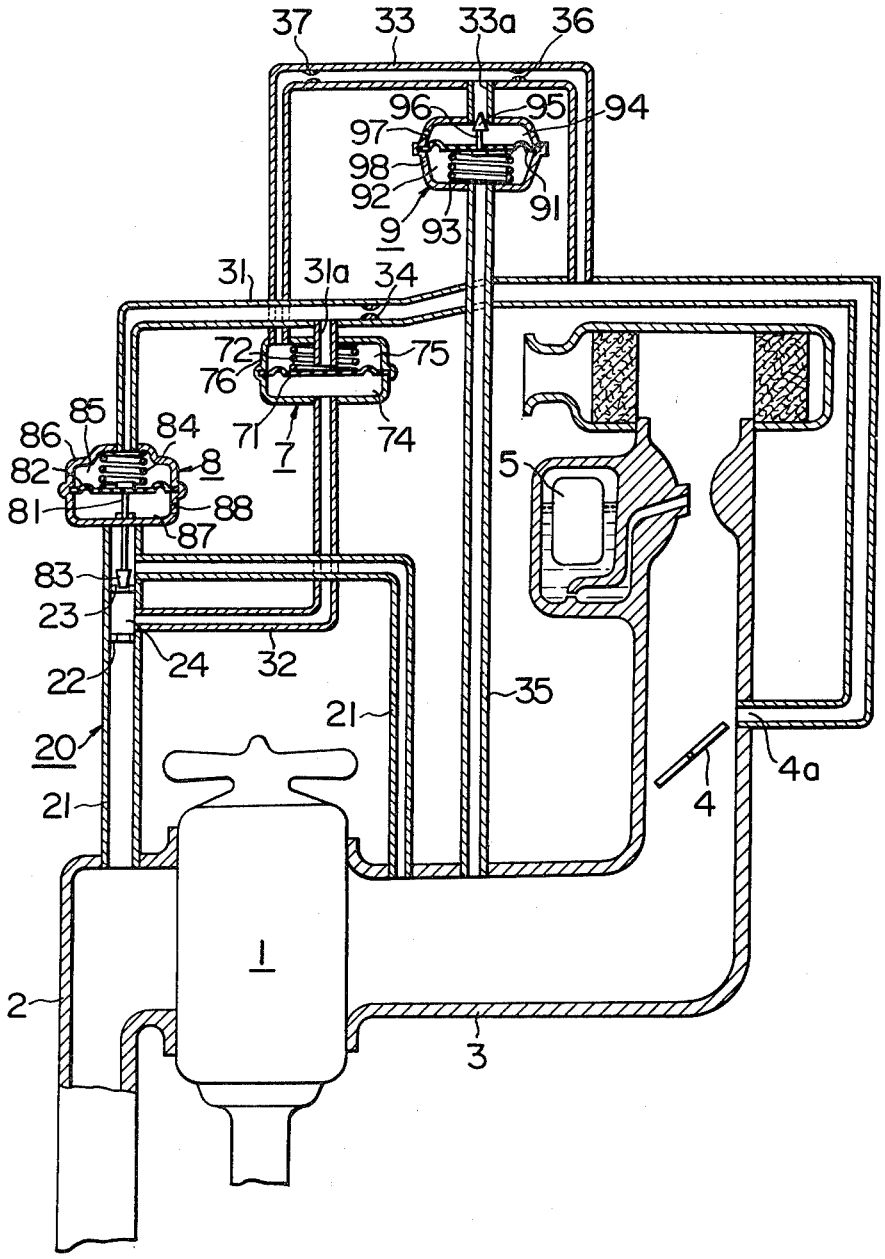
FIGS. 9 and 10 are schematic views of second and third embodiments, respectively, of the present invention.

The second embodiment shown in FIG. 9 is substantially similar in construction to the first embodiment shown in FIG. 3 except that the negative throttle pressure is used also as the source of pressure signal and an additional restriction 37 is inserted in the third pressure pipe 33 between the branch pipe 33*a* and modulator 7.

Therefore the correction pressure signal which is controlled by the negative pressure valve 9 as well as the negative throttle pressure are transmitted into the fourth pressure chamber 75 of the modulator 7. The negative pressure in the fourth pressure chamber 75 decreases with decrease in load or increases with increase in load and rotational speed of the engine. Thus, the external exhaust gas recirculation may be controlled as in the case of the first embodiment.

THIRD EMBODIMENT, FIG. 10

Figure 10:
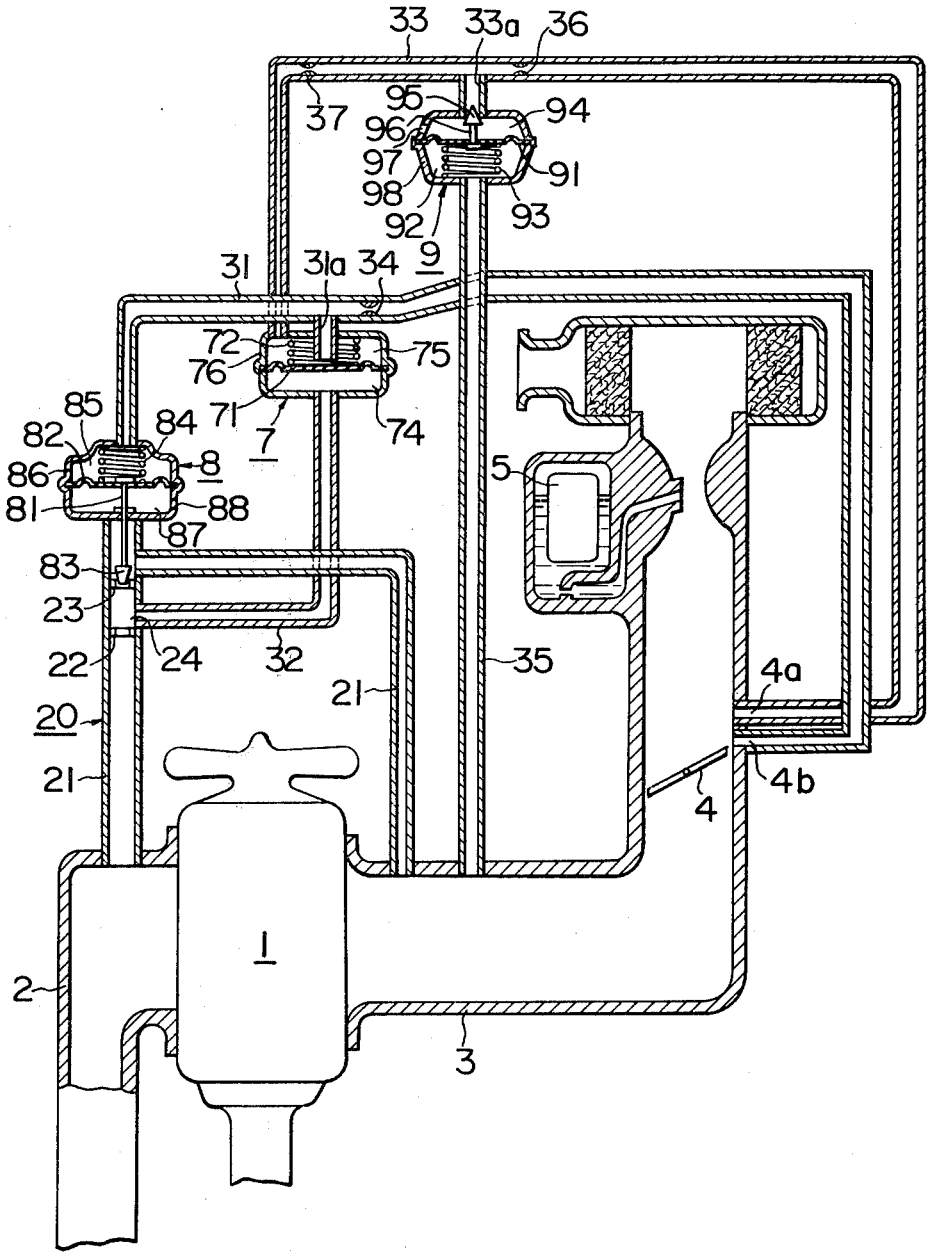

The third embodiment shown in FIG. 10 is substantially similar in construction to the second embodiment shown in FIG. 9 except that while the third pressure pipe 33 is communicated with the throttle port 4*a*, the first pressure pipe 31 is communicated with a second throttle port 4*b* downstream of the first throttle port 4*a* and upstream of the throttle valve 4 as completely closed. The "negative throttle pressure" at the second throttle port 4*b* which varies depending upon the rotational speed of the engine is generally negatively higher than the negative throttle pressure at the first throttle port 4*a* (See FIG. 4). However, in case of idling, the negative throttle pressure at the second throttle port 4*b* becomes negatively lower or rises to a pressure closer to the atmospheric pressure of the order of minus tens mm Hg because the second throttle port 4*b* is positioned upstream of the throttle valve 4 and the rotational speed of the engine is low.

Therefore, under the normal conditions the control valve 8 may be operated in a reliable and dependable manner under a negatively high pressure, but in case of idling the valve body 83 is pressed against the valve seat 23 under the force of the biase spring 84 of the control valve 8 so that the exhaust gas recirculation passage 21 may be closed.

In summary, according to the present invention the amount of exhaust gases to be recirculated is made proportional to the amount of intake air by utilizing the pressure of the exhaust gases which is substantially in proportion to the amount of intake air. In addition, the amount of exhaust gases to be recirculated is controlled in such a way that the external EGR ratio may be proportional to the load; that is when the load is low the external EGR ratio is made high while when the load is light the ratio is made low. Therefore the external exhaust gas recirculation may be controlled in an ideal manner, whereby the effective reduction in NOx may be attained.

In addition, the "negative throttle pressure" which varies depending upon the rotational speed of the engine is used as a pressure source for the correction signal which controls the external EGR ratio so that the latter may be automatically corrected in response to the variation in rotational speed of the engine. Thus the ideal control of the external exhaust gas recirculation may be obtained without being adversely affected by the rotational speed of the engine.

What is claimed is:

1. An exhaust gas recirculation system for an internal combustion engine comprising:

an exhaust gas recirculation passage (21) communicating an exhaust pipe of an engine with an intake pipe of said engine at a position downstream of a throttle valve disposed in said inake pipe for recirculating a portion of exhaust gases from said exhaust pipe to said intake pipe;

a restriction (22) and a valve seat (23) respectively disposed in series in said exhaust gas recirculation passage (21) for forming a pressure chamber (24) in said recirculation passage between said restriction (22) and said valve seat (23);

a control valve (8) having a first diaphragm chamber (85), a first deformable diaphragm (82) responsive to the pressure in said first diaphragm chamber (85), and a valve body (83) connected to said first diaphragm for cooperating with said valve seat (23) to form a variable orifice;

a pressure pipe (31) communicating said first diaphragm chamber (85) of said control valve (8) with a source of negative pressure in said intake pipe (3);

a modulator (7) having a second diaphragm (71) and a second and a third diaphragm chambers (74, 75) divided by said second diaphragm (71), said second diaphragm chamber (74) being communicated with said pressure chamber (24), said third diaphragm pressure chamber (75) being communicated with said intake pipe through a throttle port (4*a*) for modulating the pressure in said first diaphragm chamber (85) in response to the pressures in said second and third diaphragm chambers (74, 75) of said modulator (7), said throttle port (4*a*) being positioned such that it is upstream of said throttle valve (4) when it is closed and it is downstream of said throttle valve (4) when it is opened by a predetermined angle; and a negative pressure control valve (9) having a third diaphragm (91), and a fourth and fifth diaphragm chambers (92, 94) divided by said third diaphragm (91), said fourth diaphragm chamber (92) being communicated with said intake pipe downstream of said throttle valve, said fifth diaphragm chamber (94) being communicated with the atmosphere and with said third diaphragm chamber (75) of said modulator (7), and means (95, 96) connected to said third diaphragm (91) for controlling the communication between said fifth diaphragm chamber (94) of said negative pressure control valve (9) and said third diaphragm chamber (75) of said modulator (7) to introduce air to said third diaphragm chamber (7) in response to the pressure in said fourth diaphragm chamber (92), so that the amount of air introduced into said third diaphragm chamber (75) is increased in accordance with the increase of the negative pressure in said intake pipe, whereby the pressure in said pressure chamber (24) is decreased in accordance with the increase of the negative pressure in said intake pipe and increase of a rotational speed of said engine.

2. An exhaust gas recirculation system as set forth in claim 1, wherein said pressure pipe (31) communicates said first diaphragm chamber (85) of said control valve (8) with said intake pipe (3) at a position downstream of the throttle valve.

3. An exhaust gas recirculation system as set forth in claim 1, wherein said pressure pipe (31) communicates said first diaphragm chamber (85) of said control valve (8) with said intake pipe (3) through said throttle port (4*a*).

4. An exhaust gas recirculation system as set forth in claim 1, wherein said pressure pipe (31) communicates said first diaphragm chamber (85) of said control valve (8) with said intake pipe (3) through a second throttle port (4*b*) which is positioned downstream of said first mentioned throttle port (4*a*) and upstream of said throttle valve (4) when it is closed.

* * * * *